United States Patent [19]

Stibal

[11] Patent Number: 4,796,507

[45] Date of Patent: Jan. 10, 1989

[54] REED HOLDING DEVICE

[76] Inventor: Terry L. Stibal, P.O. Box 768, Belleville, Ill. 62222-0768

[21] Appl. No.: 823,347

[22] Filed: Jan. 28, 1986

[51] Int. Cl.[4] ..... G10D 9/02

[52] U.S. Cl. ..... 84/383 A

[58] Field of Search ..... 84/318, 383 B; 248/205.2; 24/442–450

[56] References Cited

U.S. PATENT DOCUMENTS

| | | | |
|---|---|---|---|
| 555,561 | 3/1896 | Cadwallader | 84/383 B |
| 1,496,535 | 6/1924 | Hammann | 84/383 B |
| 2,292,584 | 8/1942 | Tafarella | 84/383 B |
| 3,941,159 | 3/1976 | Toll | 24/442 X |
| 4,056,997 | 11/1977 | Rovner | 84/383 B |
| 4,185,535 | 1/1980 | Lorenzini | 84/383 B |

*Primary Examiner*—Benjamin R. Buller

[57] ABSTRACT

A reed holding device for single-reed woodwind musical instruments constructed of a strip of knitted or woven material having a plurality of pile loops on one of its surfaces, and a plurality of hooks formed by cutting loops on the opposite surface. The strip is wound around the mouthpiece and reed of the musical instrument in a helical fashion with the surface having the uncut loops placed against the surface of the mouthpiece and reed. The free ends of the strip are secured in place by pressing the pile loops on the one surface into the formed hooks on the other surface on the wrapping placed immediately above or below.

3 Claims, 1 Drawing Sheet

REED HOLDING DEVICE

BACKGROUND OF THE INVENTION

This invention relates to single-reed woodwind musical instruments and specifically to an improved means of attachment of a single beating reed to the mouthpiece table of such instruments.

Heretofore, single-reed woodwind musical instruments, such as those of the clarinet and saxophone families, utilized one of two varieties of reed holding devices (commonly called ligatures) to secure the single beating reed that acts as the sound generator to the reed attachment area, or table, of the instrument mouthpiece. From the inception of the single-reed mouthpiece, a wrapping of waxed string, twine or cord around both the mouthpiece and the reed has been used, at first from the want of better means. Even today, this method is preferred in Germany and some other European nations. It is generally agreed upon by those familiar with these families of instruments that the use of string, twine or cord affords a greater degree of flexibility to the reed which in turn allows the instrument to produce a superior tone that is more responsive to the manipulation of the player. However, the musical qualities of a string, twine-, or cord-wrapped reed and mouthpiece combination are more than outweighed by the cumbersome and time-consuming process of winding and unwinding the string, twine or cord when it becomes necessary to rapidly change and/or adjust the reed during the course of a performance. In order to overcome this disadvantage, the second variety of reed holding device was developed, starting with the invention of the twin-screw metal band reed holding device by the great clarinet virtuoso Ivan Mueller at the beginning of the nineteenth century. Since that time, such reed holding devices have generally replaced the use of string, twine or cord throughout most of the world. This type of reed holding device, whether of metal, plastic or of other materials, affords the player of a single-reed windwind musical instrument a means of securing the reed to the mouthpiece that allows rapid removal and replacement. However, such convenience of adjustment carries with it the loss of the flexible response allowed by the use of string, twine or cord. This is due to the rigid formed materials used in these devices which tend to restrict the free vibration of the reed. In addition, such rigid formed devices present the additional disadvantage of a lack of adaptability to all of the sizes and varieties of single-reed mouthpieces in use for a given type of instrument. Mouthpieces for all single-reed woodwind musical instruments come in a variety of lengths, diameters and tapers. For example, the degree of taper can vary from virtually no taper at all, as is seen in some metal saxophone mouthpieces, to a high degree of taper, such as seen in certain hard rubber mouthpieces made for the same instruments. Finally, the reed holding devices of this type are relatively complex and correspondingly harder to fabricate compared with one composed of string, twine or cord.

Although several attempts have been made in the prior art to combine the features of the above types of reed holding devices, no adequate solution to the problem of even distribution of a flexible holding force (such as that provided by string, twine or cord) over the length of the reed of a single-reed woodwind mouthpiece without the corresponding disadvantages of application of the multiple wrappings of string, twine or cord has yet been proposed. In addition, all of the attempts in the prior art have been incapable of being applied to all of the various geometries of mouthpieces available for a given type of instrument. For example, Lorenzini U.S. Pat. No. 4,185,535 shows the use of spaced string restraints combined with either tapered or straight rigid brackets. This embodiment applies tension to the restraints at only two locations, and must be procured in a configuration matching that of the mouthpiece in order to allow proper use. The provision of a fixed holding means for the string restraints does not allow the restraints to freely conform to any irregularities presented by the contours of the reed and tends to leave one or more of the various sections of the string not in proper contact with the bark of the reed. The Rovner U.S. Pat. No. 4,056,997 utilizes a strip of rubber-impregnated fabric adjusted by a single thumbscrew. It can be seen that the use of an elastic medium such as rubber-impregnated fabric does not duplicate the even holding characteristics of a ligature made of a continuous wrapping of string, twine or cord. Furthermore, the embodiment shown does not apply tension evenly throughout the entire strip when used on all geometries of mouthpiece and reed combinations due to the fixed configuration of the fabric strip combined with the limited adjustment range of the single thumbscrew provided. The Tafarella U.S. Pat. No. 2,292,584 approaches the problem by another means, utilizing a rigid collar of plastic material provided with strips of felt which isolate the device from contact with the mouthpiece. However, this embodiment does not restrain the reed with string-like means since it employs a slide of plastic material bearing against the rigid collar to locate and secure the reed in place. Also, the variations of taper between individual geometries of mouthpieces available for a given type of instrument combined with the limited adjustment range provided by this embodiment require a specific version for each style of mouthpiece available for a given type of instrument. The Cadwallader U.S. Pat. No. 555,561 employs a continuously-wrapped quantity of cord wound between two metal loops adjusted by a single thumbscrew. Although the cord provides a flexible holding medium, the friction between the wrappings prevents the cord from evenly distributing the pressure applied by the single thumbscrew over the bark of the reed. In addition, the limited adjustment range provided by this embodiment would require a specific version for each style of mouthpiece available for a given type of instrument.

None of the items in the prior art describe a reed holding device which provides the even application of pressure to the back of the single-beating reed that affords the freedom of response as that applied by a continuous wrapping of string, twine or cord while at the same time allowing the ease of application, removal and adjustment afforded by the various types of Mueller-derived metal or plastic screw adjustable ligatures.

These and various other problems were not satisfactorily resolved until the emergence of the instant invention.

SUMMARY OF THE INVENTION

In accordance with the present invention, there is provided a reed holding device for single-reed woodwind instruments. The present invention further provides a readily adaptable reed holding device that allows the freedom of response afforded by string, twine or cord without the extreme inconvenience of application, removal and adjustment provided by such reed holding devices.

Further objects and advantages of my invention will become apparent from a consideration of the drawings and ensuing description thereof.

DETAILED DESCRIPTION OF THE PERFERRED EMBODIMENTS OF THE INVENTION

Figure 2:
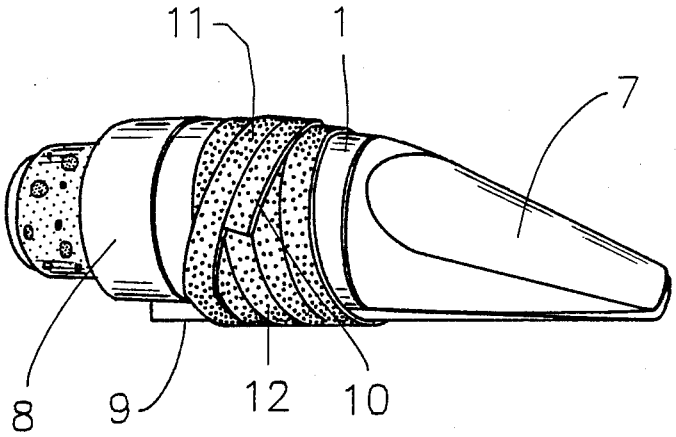
FIG. 2 is a perspective view showing the reed holding device in place on the mouthpiece of a clarinet.
Figure 3:
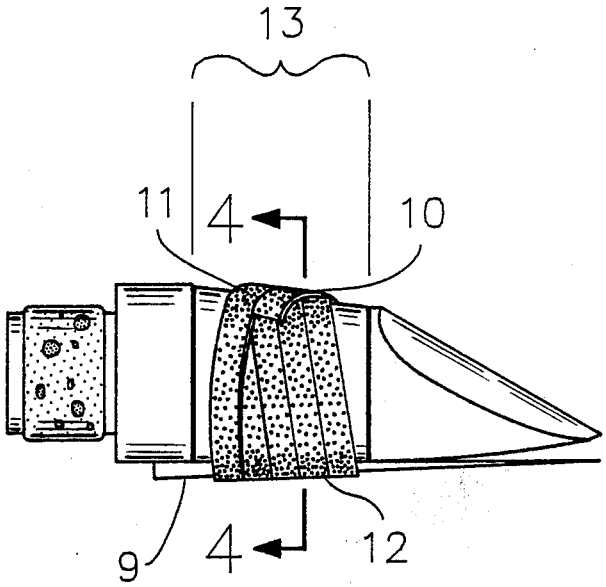
FIG. 3 is a side view showing the reed holding device in place on the mouthpiece of a clarinet.
Figure 4:
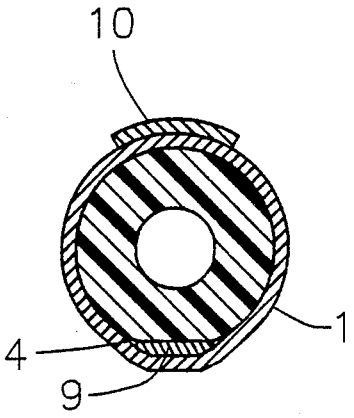
FIG. 4 is a cross-sectional view along lines 4—4 of FIG. 3.
Figure 1:
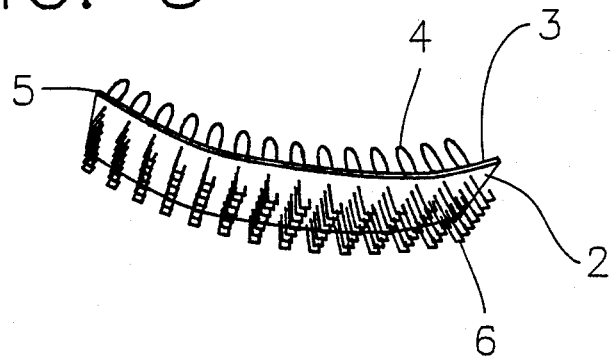
FIG. 1 is a perspective view showing a portion of the reed holding device.

As shown in FIG. #1 of the drawings, the holding device 1 includes a base 2 of a relatively non-elastic flexible substance such as woven cloth, metal mesh or other suitable material having first and second surfaces 3 and 5. Attached to said first and second surfaces 3 and 5 are a plurality of closely spaced interengageable hooking elements, where said first surface 3 is provided with hooking elements comprising loops of flexible resilient material 4 secured thereto in positions generally extending vertically from said first surface and where said second surface 5 is provided with hooking elements comprising hooks made of flexible resilient material 6 secured thereto in positions generally extending vertically from said second surface. The physical dimensions of said base 2 may be varied dependent on the specific type of instrument to which said holding device 1 is to be applied. It has been found that one specific length and width of said holding device 1 will fit all variations of diameter, taper and length of the various styles of mouthpiece available for each given type of instrument. For example, all versions of soprano clarinet mouthpieces commonly encountered on the commercial market can utilize a length of base 2 of 22⅜ inches with a width of 3/16 inch.

FIG. #2 shows said holding device 1 applied to a single-reed musical instrument mouthpiece 7 and reed 9 of the conventional type used with clarinets, saxophones or the like. Said holding device 1, of a length and width suitable for the mouthpiece at hand, is wound around said mouthpiece 7 and said reed 9 in a helical fashion with said first surface 3 placed against the outer surface 8 of said mouthpiece 7 and against the reed 9. The ends 10 and 11 of said holding device 1 are secured in place by pressing said ends 10 and 11 against the surface 12 formed by the helical windings of said holding device 1, thus engaging said loop elements 4 attached to said first surface 3 into said hook elements 6 attached to said second surface 5. Once so configured, the combination of said mouthpiece 7 and said reed 9 surrounded by the windings of said holding device 1 places said loop elements 4 in compression, thereby exerting holding pressure against said reed 9.

It can be seen that once said holding device 1 is so configured, an adjustment of the degree of holding pressure applied to the reed by said holding device 1 may be obtained in two ways. The most direct of these two methods is performed by lifting either of said ends (10 or 11) from said surface 12, slightly increasing or decreasing the tension on the detached end, and then again pressing said lifted end (10 or 11) onto said surface 12. The resultant change of tension in said base 2 causes either an increase or decrease in the degree of compression of said loops of flexible resilient material 4, thereby increasing or decreasing the amount of holding pressure exerted against said reed 9. An alternate method of varying the degree of amount of holding pressure exerted by said holding device 1 is provided by sliding said holding device 1 up or down the tapered mouthpiece main body section 13.

It is noted by an inspection of FIGS. #3 and #4, that said reed 9 is secured in place by the holding pressure of said loop elements 4 attached to said first surface 3 of said holding device 1. This holding pressure, plus the unconnected circumferential wrappings of said holding device 1 that lay across the back of said reed 9, allow free vibration throughout its entire length in a similar fashion to the traditional string ligature, while still allowing rapid removal, replacement and adjustment of the reed. This is permitted since the configuration of said holding device 1 is retained when said holding device 1 is slid off of the mouthpiece due to the overlap of said ends 10 and 11 over said surface 12 presented by the successive wrappings of said holding device 1.

The invention may be embodied in other specific forms without departing from the spirit of essential characteristics thereof. The present embodiments are, therefore, to be considered in all aspects as illustrative and not restrictive. The scope of the invention being indicated by the appended claims rather than the foregoing description and all changes which come within the meaning and range of equivalency of the claims are, therefore, intended to be embraced therein.

I claim:

1. A holding device for a reed placed against a surface of a mouthpiece of a single-reed musical instrument, said device comprising a single unitary continuous strip material, having a base comprised of first and second surfaces, having attached to said first surface a plurality of loops made of flexible resilient material, and having attached to said second surface a plurality of hooks made of flexible resilient material, said strip material being wound around said mouthpiece and said reed in a helical fashion with said first surface placed against said mouthpiece and said reed, ends of said strip material secured in place by engaging said loops on said first surface into the surface of said hooks by winding of said strip material around said mouthpiece and said reed, said strip material exerting holding pressure against said reed.

2. A holding device for a reed placed against a surface of a mouthpiece of a single-reed woodwind musical instrument according to claim 1 wherein said holding pressure applied to said reed is regulated by the tension applied to said strip material when wound around said mouthpiece and said reed.

3. A holding device for a reed placed against a surface of a mouthpiece of a single-reed woodwind musical instrument according to claim 1 wherein said holding pressure applied to said reed can be varied by sliding said device up and down said mouthpiece and said reed.

* * * * *